US011017972B2

(12) United States Patent
Liu et al.

(10) Patent No.: US 11,017,972 B2
(45) Date of Patent: May 25, 2021

(54) SOLDERLESS SURFACE MOUNT FUSE

(71) Applicant: Suzhou Littelfuse OVS Co., Ltd., Suzhou (CN)

(72) Inventors: Style Liu, Suzhou (CN); Jazz Wang, Suzhou (CN); David Lv, Suzhou (CN)

(73) Assignee: Suzhou Littelfuse OVS Co., Ltd., Suzhou (CN)

( * ) Notice: Subject to any disclaimer, the term of this patent is extended or adjusted under 35 U.S.C. 154(b) by 372 days.

(21) Appl. No.: 16/088,220

(22) PCT Filed: Mar. 25, 2016

(86) PCT No.: PCT/CN2016/077333

§ 371 (c)(1),
(2) Date: Sep. 25, 2018

(87) PCT Pub. No.: WO2017/161558

PCT Pub. Date: Sep. 28, 2017

(65) Prior Publication Data

US 2020/0388457 A1 Dec. 10, 2020

(51) Int. Cl.

| | |
|---|---|
| ***H01H 85/18*** | (2006.01) |
| ***H01H 85/055*** | (2006.01) |
| ***H01H 85/175*** | (2006.01) |
| ***H01H 85/143*** | (2006.01) |

(52) U.S. Cl.

CPC ..... *H01H 85/055* (2013.01); *H01H 85/143* (2013.01); *H01H 85/175* (2013.01); *H01H 85/18* (2013.01)

(58) Field of Classification Search

CPC .. H01H 85/055; H01H 85/143; H01H 85/175; H01H 85/18

USPC ..... 337/186

See application file for complete search history.

(56) References Cited

U.S. PATENT DOCUMENTS 4,544,907 A * 10/1985 Takano ..... H01H 85/0417 337/262
4,599,596 A * 7/1986 Arikawa ..... H01H 85/0411 337/201
4,894,633 A * 1/1990 Holtfreter ..... H01H 85/0411 337/201

(Continued)

FOREIGN PATENT DOCUMENTS

CN 201204173 Y 3/2009
CN 204230191 U 3/2015

(Continued)

*Primary Examiner* — Anatoly Vortman
(74) *Attorney, Agent, or Firm* — Kacvinsky Daisak Bluni PLLC

(57) ABSTRACT

A solderless surface mount fuse including a base having a floor and a plurality of adjoining sidewalls defining a cavity, a fuse element including a separation portion spanning between two electrode portions, the separation portion and the electrode portions formed of a contiguous piece of material, the separation portion suspended within the cavity below top edges of the sidewalls of the base, and a cap having a ceiling and a plurality of adjoining sidewalls, the cap fitting over the base and the fuse element with bottom edges of the sidewalls of the cap disposed below the top edges of the sidewalls of the base, wherein the cavity of the base contains a fuse filler that completely surrounds the separation portion.

16 Claims, 3 Drawing Sheets

(56) References Cited

U.S. PATENT DOCUMENTS 5,398,015 A * 3/1995 Kudo ..... H01H 85/0417 337/255
5,446,623 A * 8/1995 Kanetake ..... H01G 9/008 361/760
5,631,620 A * 5/1997 Totsuka ..... H01H 85/0411 29/623
5,648,750 A * 7/1997 Yuza ..... H01H 85/0411 337/252
5,818,321 A * 10/1998 Muramatsu ..... H01H 85/0417 337/198
5,854,583 A * 12/1998 Falchetti ..... H01H 85/044 337/290
6,067,004 A * 5/2000 Hibayashi ..... H01H 85/044 337/186
6,275,135 B1 * 8/2001 Hibayashi ..... H01H 85/044 337/186
6,448,882 B1 * 9/2002 Inaba ..... H01H 85/044 337/159
7,248,141 B2 * 7/2007 Kobayashi ..... B23K 35/262 337/232
7,659,804 B2 * 2/2010 Harris ..... H01H 85/38 337/159
8,629,749 B2 * 1/2014 Chiu ..... H01H 85/165 337/228
9,378,917 B2 * 6/2016 Yoshida ..... H01H 85/143
9,472,364 B2 * 10/2016 Matthiesen ..... B23K 31/02
9,831,055 B2 * 11/2017 Beckert ..... H01H 69/02
10,141,150 B2 * 11/2018 Aberin ..... H01H 85/1755
10,325,746 B2 * 6/2019 Schlaak ..... H01H 85/0082
2008/0191832 A1 * 8/2008 Tsai ..... H01H 85/046 337/297
2010/0245025 A1 9/2010 de Leon et al.
2015/0002258 A1 * 1/2015 Yoshida ..... H01H 85/38 337/273
2016/0172143 A1 * 6/2016 Yoneda ..... H01H 85/08 337/186

FOREIGN PATENT DOCUMENTS

JP 2015065156 A 4/2015
KR 0165918 B1 1/1999
KR 101262815 B1 5/2013
WO WO-2015030023 A1 * 3/2015 ..... H01H 85/143

* cited by examiner

SOLDERLESS SURFACE MOUNT FUSE

FIELD OF THE DISCLOSURE

The present disclosure relates generally to the field of circuit protection devices, and relates more particularly to a solderless surface mount fuse.

BACKGROUND OF THE DISCLOSURE

A conventional surface mount fuse includes a fuse element disposed within a cavity of a housing defined by a cap and a base that are fastened together in a vertically-stacked arrangement. The base defines a lower portion of the housing and the cavity, and the cap defines an upper portion of the housing and the cavity. Electrodes are disposed on opposing, exterior sides of the housing and are connected to the ends of the fuse element with solder at the juncture of the base and the cover. A "fuse filler" material (e.g., sand) may be deposited in the base, below the fuse element, before the fuse is assembled. The fuse filler may assist in quenching an electrical arc that may form when the fusible element melts or otherwise separates upon an overcurrent condition, thereby mitigating arcing and also absorbing heat that may otherwise burn the fuse.

The above-described fuse arrangement is associated with several shortcomings. For example, the solder that is used to connect the electrodes to the fuse element may deteriorate as a result of improper application, high temperature operation (e.g., in high current applications), and/or mechanical stress, thus causing premature failure of the fuse. High-temperature, high lead-containing solder with a melting point higher than the surface mount reflow temperature has been used to ensure connections between electrodes and fuse elements in surface mount fuses, though such solder is known to cause environmental pollution.

A further shortcoming associated with the above-described fuse arrangement is that the fuse filler can only be deposited below the fuse element, in the lower portion of the housing defined by the base, thereby leaving the top of the fuse element uncovered. The exposed top of the fuse element may be left susceptible to electrical arcing upon the occurrence of an overcurrent condition. Furthermore, heat emitted from the top of the fuse is not absorbed or is only partially absorbed by the fuse filler and may burn the fuse, resulting in a hazardous condition. Still further, noxious metallic vapors emanating from the fuse element upon its melting may be allowed to exit the housing at the juncture of the base and the cap.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

An exemplary embodiment of a solderless surface mount fuse in accordance with the present disclosure may include a base having a floor and a plurality of adjoining sidewalls defining a cavity, a fuse element including a separation portion spanning between two electrode portions, the separation portion and the electrode portions formed of a contiguous piece of material, the separation portion suspended within the cavity below top edges of the sidewalls of the base, and a cap having a ceiling and a plurality of adjoining sidewalls, the cap fitting over the base and the fuse element with bottom edges of the sidewalls of the cap disposed below the top edges of the sidewalls of the base, wherein the cavity of the base contains a fuse filler that surrounds and covers the separation portion.

DETAILED DESCRIPTION

Figure 1:
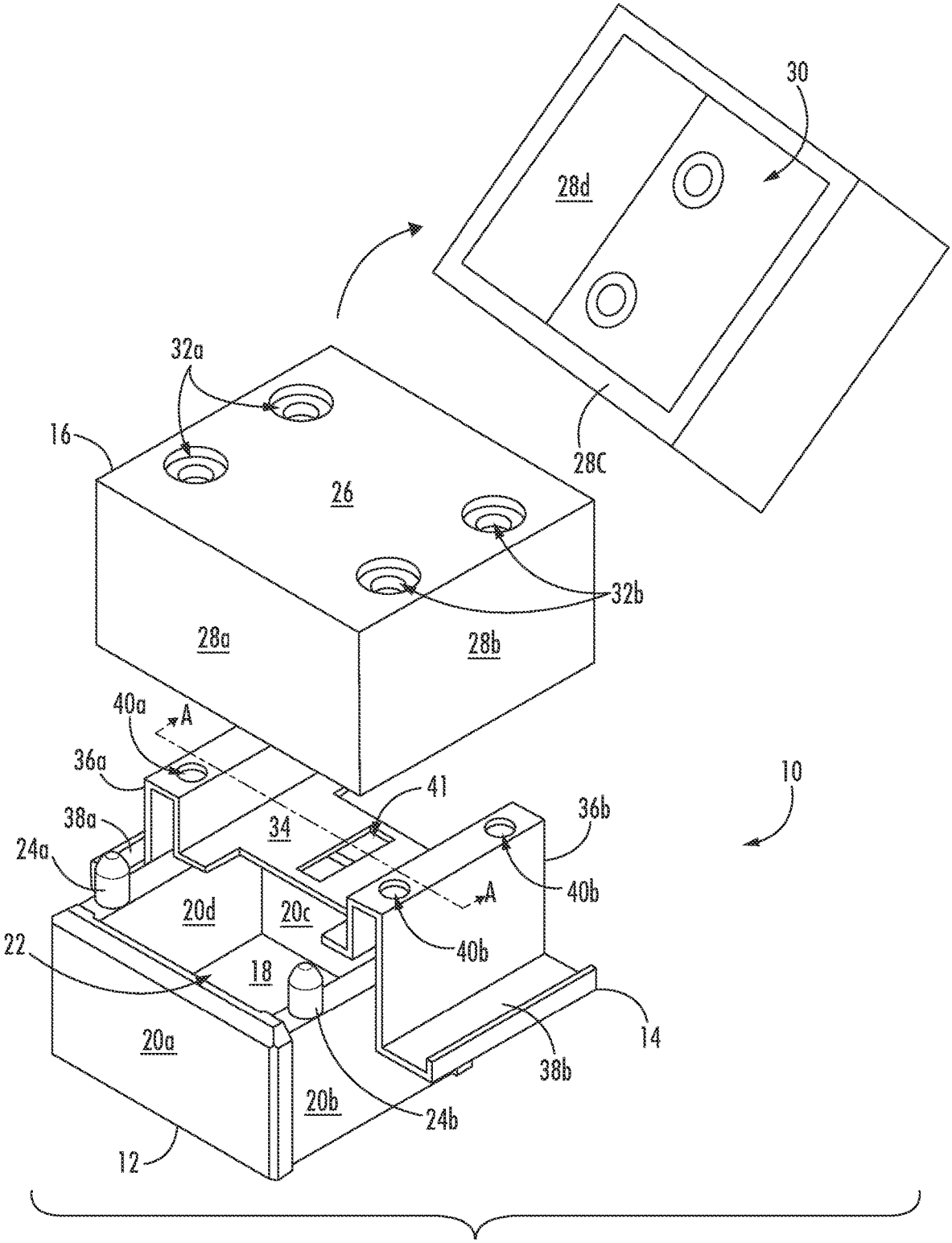
FIG. 1 is a perspective view illustrating an exemplary embodiment of a solderless surface mount fuse in accordance with the present disclosure.

A solderless surface mount fuse in accordance with the present disclosure will now be described more fully with reference to the accompanying drawings, in which preferred embodiments of the solderless surface mount fuse are presented. The solderless surface mount fuse, however, may be embodied in many different forms and should not be construed as being limited to the embodiments set forth herein. Rather, these embodiments are provided so that this disclosure will be thorough and complete, and will fully convey the scope of the solderless surface mount fuse to those skilled in the art. In the drawings, like numbers refer to like elements throughout unless otherwise noted.

Referring now to FIG. 1, a perspective view of a solderless surface mount fuse 10 (hereinafter "the fuse 10") in accordance with an exemplary embodiment of the present disclosure is shown. For the sake of convenience and clarity, terms such as "top," "bottom," "upper," "lower," "vertical," "horizontal," "height," "width," and "depth" may be used herein to describe the relative placement, orientation, and dimensions of the fuse 10 and its various components, all with respect to the geometry and orientation of the fuse 10 as it appears in FIG. 1.

The fuse 10 may include a base 12, a fuse element 14, and a cap 16. The fuse element 14 may be "sandwiched" between the base 12 and the cap 16 in a vertically stacked arrangement as will be described in greater detail below. The base 12 and the cap 16 may be formed of any suitable, electrically insulating material, including, but not limited to, glass, ceramic, plastic, etc. The fuse element 14 may be formed of any suitable, electrically conductive material, including, but not limited to tin, nickel, copper, zinc etc.

The base 12 may be a generally box-shaped member having an open top. The base 12 may include a floor 18 and adjoining sidewalls 20*a*, 20*b*, 20*c*, 20*d* that define an interior cavity 22. Pairs of spaced-apart mounting posts 24*a*, 24*b* may extend upwardly from top edges of the opposing sidewalls 20*b*, 20*d* (best shown in FIG. 2).

Figure 3:
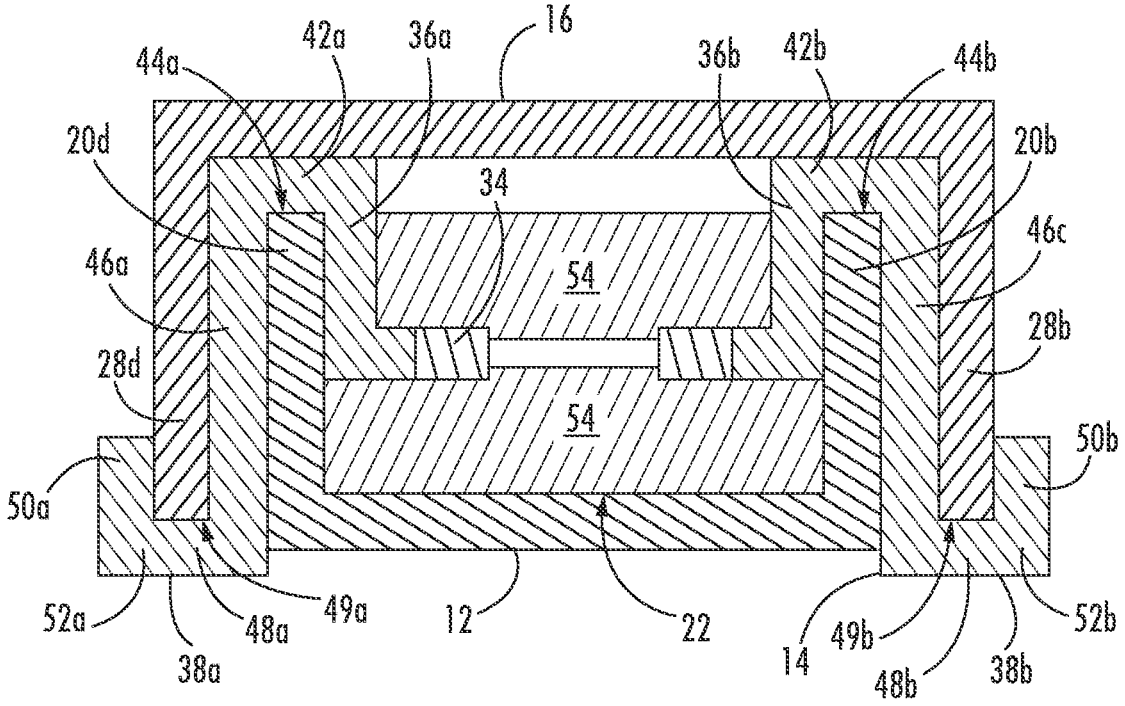
FIG. 3 is cross sectional side view illustrating the solderless surface mount fuse shown in FIG. 1 taken along plane A-A.

The cap 16 may be a generally box-shaped member having an open bottom. The cap 16 may include a ceiling 26 and adjoining sidewalls 28*a*, 28*b*, 28*c*, 28*d* that define an interior cavity 30. The interior width and depth of the cap 16 may be larger than the exterior width and depth of the base 12 for allowing the cap 16 to fit over the base 12 and the fuse element 14 as shown in FIG. 3 and as described in greater detail below. Pairs of spaced-apart mounting holes 32*a*, 32*b* may be formed in the ceiling 26 and may be arranged to receive the mounting posts 24*a*, 24*b* of the base 12 when the fuse 10 is assembled.

The fuse element 14 may be formed from a single, contiguous piece or quantity of material that has been bent, crimped, cast, cut, punched, drilled, molded, or otherwise formed to define the depicted shape that includes a separation portion 34 spanning horizontally between two electrode portions 36*a*, 36*b* having electrical connection terminals 38*a*, 38*b*. The fuse element 14 may be configured such that the separation portion 34 is disposed within the cavity 22 of the base 12 and such that the terminals 38*a*, 38*b* are disposed below and outside of the cap 16 when the fuse 10 is assembled as will be described in greater detail below. Notably, no solder, adhesive, or other fastening means are used to join the separation portion 34 to the electrode portions 36*a*, 36*b* of the fuse element 14. Thus, relative to soldered junctures that are commonly employed in conventional surface mount fuses, the junctures of the separation portion 34 and the electrode portions 36*a*, 36*b* are less susceptible to premature failure resulting from high temperature operation and/or mechanical stress. Pairs of spaced-apart pass-through holes 40*a*, 40*b* may be formed in the electrode portions 36*a*, 36*b* and may be arranged to receive the mounting posts 24*a*, 24*b* of the base 12 (as best shown in FIG. 2) when the fuse 10 is assembled.

Figure 2:
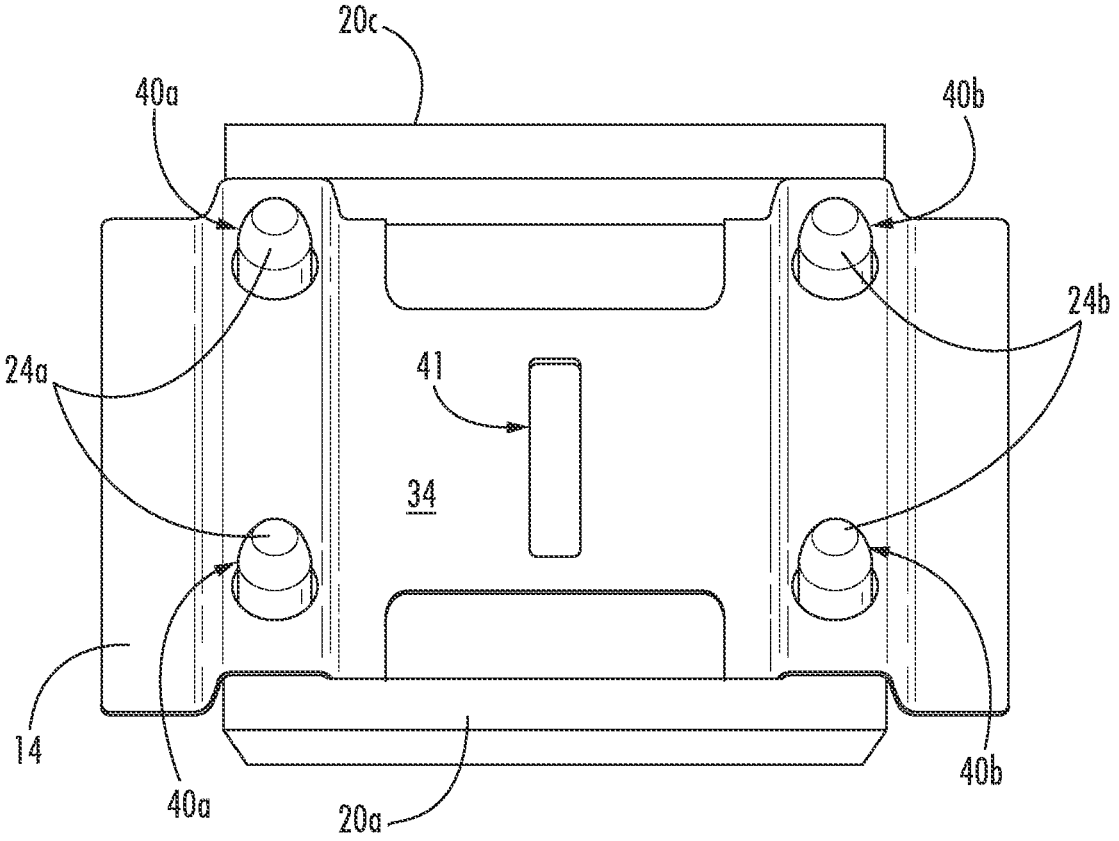
FIG. 2 is a top view illustrating the solderless surface mount fuse shown in FIG. 1 with the cap removed.

Still referring to FIG. 1, the separation portion 34 of the fuse element 14 may be relatively narrower and thus smaller in conductive area/volume as compared to the electrode portions 36*a*, 36*b* extending from the longitudinal ends thereof (see also FIG. 2). A slot 41 may be formed in the separation portion 34 to further reduce the conductive area/volume of the separation portion 34 relative to the electrode portions 36*a*, 36*b*, but this feature is not critical. Thus, the separation portion 34 may provide a "weak link" in the fuse element 14 that is configured to rupture or melt when a current exceeding a predefined threshold level (i.e. fuse rating) flows through the fuse element 14. The slot 41 may increase the breaking capacity of the fuse by providing multiple arcing channels. In some contemplated embodiments, the separation portion 34 may be thinner than the electrode portions 36*a* and 36*b*, thus making the fuse 10 faster-acting upon a fault current. Furthermore, it may reduce fuse power dissipation and temperature in field application. It is further contemplated that a tin overlay may be deposited on the separation portion 34 to further reduce fuse power dissipation and temperature. As will be appreciated by those of ordinary skill in the art, the particular size, volume, and conductive material comprising the separation portion 34 may all contribute to the fuse rating of the fuse 10.

Referring now to FIG. 3, a cross-sectional side view of the assembled fuse 10 taken along the plane A-A in FIG. 1 is shown. With particular reference to the fuse element 14, the electrode portions 36*a*, 36*b* may extend upwardly from the longitudinal ends of the separation portion 34 and may terminate in respective, uppermost hangers 42*a*, 42*b* that are bent or otherwise formed in an inverted U-shape to define downwardly-facing pockets 44*a*, 44*b* for receiving the top edges of the opposing sidewalls 20*b*, 20*d* of the base 12 in a close clearance relationship therewith. Sidewalls 46*a*, 46*b* may extend downwardly from the hangers 42*a*, 42*b* and may terminate in respective, lowermost cradles 48*a*, 48*b* (which include the terminals 38*a*, 38*b*) that are bent or otherwise formed in a U-shape to define upwardly-facing pockets 49*a*, 49*b* for receiving the bottom edges of the opposing sidewalls 28*b*, 28*d* of the cap 16. Alternative embodiments of the fuse 10 are contemplated in which the vertical segments 50*a*, 50*b* and/or the horizontal segments 52*a*, 52*b* of the cradles 48*a*, 48*b* are omitted. If only the vertical segments 50*a*, 50*b* are omitted, the horizontal segments 52*a*, 52*b* of the cradles 48*a*, 48*b* may define the terminals 38*a*, 38*b* of the electrode portions 36*a*, 36*b*. If both the vertical segments 50*a*, 50*b* and the horizontal segments 52*a*, 52*b* of the cradles 48*a*, 48*b* are omitted, the lowermost termini of the sidewalls 46*a*, 46*b* may define the terminals 38*a*, 38*b* of the electrode portions 36*a*, 36*b*.

The cavity 22 of the base may be filled with a fuse filler 54 which may be deposited in the cavity 22 before the fuse 10 is assembled. The fuse filler 54 may be, or may include, any of a variety of arc-quenching materials recognized by those of ordinary skill in the art to be suitable for use in a surface mount fuse. A non-limiting example of such a material is silica.

Owing to the above-described configuration of the base 12 and the fuse element 14, the hangers 42*a*, 42*b* of the electrode portions 36*a*, 36*b* may rest on the top edges of the opposing sidewalls 20*b*, 20*d* of the base 12 with the separation portion 34 of fuse element 14 suspended within the cavity 22, below the top edges of the sidewalls 20*a-d*. Thus, when the cavity 22 of the base 12 is filled with the fuse filler 54, the fuse filler 54 may reach above, and may completely cover, the top of the separation portion 34. Heat that may emanate upwardly from the separation portion 34 upon an overcurrent condition in the fuse element 14 may therefore be absorbed by the fuse filler 54, mitigating heating and burning of the cap 16. Additionally, the fuse filler 54 may prevent arcing between broken ends of the melted separation portion 34 where such arcing might otherwise propagate if the top of the separation portion 34 were exposed (i.e., not covered by the fuse filler 54), thereby providing the fuse 10 with improved breaking capacity.

Still referring to FIG. 3, the cap 16 may fit over the fuse element 14 and the base 12 with the sidewalls 28*b*, 28*d* of the cap 16 in close horizontal abutment with the sidewalls 46*a*, 46*b* of the electrode portions 36*a*, 36*b*, with the sidewalls 28*a*, 28*c* of the cap 16 in close horizontal abutment with the sidewalls 20*a*, 20*c* of the base 16 (see FIG. 1), and with the bottom edges of the sidewalls 28*b*, 28*d* of the cap 16 seated in the cradles 48*a*, 48*b*. The terminals 38*a*, 38*b* may protrude from below the cap 16 and may thus facilitate electrical connection to electrical leads on a printed circuit board (PCB), for example. The tightly overlapping sidewalls 20*a*, 20*c*, 28*a*, 28*c*, 28*b*, 28*d*, and 46*a*, 46*b* of the base 12, electrode portions 36*a*, 36*b*, and cap 16 may seal the interior of the fuse 10 and may effectively prevent gases from escaping therefrom. For example, when the separation element 34 melts during an overcurrent condition, the seal created by the overlapping sidewalls 20*a*, 20*c*, 28*a*, 28*c*, 28*b*, 28*d*, and 46*a*, 46*b* may prevent noxious metal vapors from leaking out of the fuse 10.

When the fuse 10 is assembled (i.e., when the base 12, the fuse element 14, and the cap 16 are sandwiched together in a vertically stacked arrangement), the mounting posts 24*a*, 24*b* of the base 12 may extend through the pass-through holes 40*a*, 40*b* in the fuse element 14 and into the mounting holes 32*a*, 32*b* in the ceiling 26 of the cap 16 (see FIGS. 1 and 2). The mounting posts 24*a*, 24*b* may be fused to the ceiling 26 by hot riveting to securely fasten the base 12, fuse element 14, and cap 16 together. Additionally or alternatively, various other methods, substances, and/or structures may be employed for fastening the components of the fuse 10 together in the assembled configuration. These include, but are not limited to, various adhesives, various mechanical fasteners, welding and various structural features of the base 12, the fuse element 14, and/or the cap 16 that may facilitate friction fit, snap fit, or interference fit therebetween.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A solderless surface mount fuse comprising:

a base comprising a floor and four adjoining sidewalls defining a cavity;

a fuse element comprising a separation portion spanning between two electrode portions, the separation portion and the electrode portions formed of a contiguous piece of material, the separation portion suspended within the cavity below top edges of the sidewalls of the base; and a cap comprising a ceiling and four adjoining sidewalls extending perpendicularly from edges of the ceiling, the cap fitting over the base and the fuse element with bottom edges of the sidewalls of the cap disposed below the top edges of the sidewalls of the base, and the sidewalls of the cap surrounding the fuse element and the sidewalls of the base;

wherein the electrode portions define respective hangers that extend over, and rest on, respective top edges of opposing sidewalls of the base.

2. The solderless surface mount fuse of claim 1, further comprising a mounting post extending upwardly from the base and into a mounting hole in the ceiling.

3. The solderless surface mount fuse of claim 2, wherein the mounting post is fastened to the ceiling.

4. The solderless surface mount fuse of claim 2, wherein the mounting post extends through a respective pass-through hole formed in one of the electrode portions.

5. The solderless surface mount fuse of claim 1, wherein each of the electrode portions includes a sidewall that extends vertically between an adjacent sidewall of the base and an adjacent sidewall of the cap and defines a terminal that protrudes from below a bottom edge of the adjacent sidewall of the cap.

6. The solderless surface mount fuse of claim 5, wherein the terminals define respective cradles that receive the bottom edges of the respective adjacent sidewalls of the cap.

7. The solderless surface mount fuse of claim 1, wherein the cavity of the base contains a fuse filler that surrounds the separation portion.

8. The solderless surface mount fuse of claim 7, wherein the fuse filler covers a top of the separation portion.

9. A solderless surface mount fuse comprising:

a base comprising a floor and a plurality of adjoining sidewalls defining a cavity;

a fuse element comprising a separation portion spanning between two electrode portions, the separation portion and the electrode portions formed of a contiguous piece of material; and a cap comprising a ceiling and four adjoining sidewalls extending perpendicularly from edges of the ceiling, the cap fitting over the base and the fuse element with bottom edges of the sidewalls of the cap disposed below the top edges of the sidewalls of the base, and the sidewalls of the cap surrounding the fuse element and the sidewalls of the base;

wherein the cavity of the base contains a fuse filler that surrounds the separation portion; and wherein the electrode portions define respective hangers that extend over, and rest on, respective top edges of opposing sidewalls of the base.

10. The solderless surface mount fuse of claim 9, wherein the separation portion is suspended within the cavity below the top edges of the sidewalls of the base.

11. The solderless surface mount fuse of claim 9, further comprising a mounting post extending upwardly from the base and into a mounting hole in the ceiling.

12. The solderless surface mount fuse of claim 11, wherein the mounting post is fastened to the ceiling.

13. The solderless surface mount fuse of claim 11, wherein the mounting post extends through a respective pass-through hole formed in one of the electrode portions.

14. The solderless surface mount fuse of claim 9, wherein each of the electrode portions includes a sidewall that extends vertically between an adjacent sidewall of the base and an adjacent sidewall of the cap and defines a terminal that protrudes from below a bottom edge of the adjacent sidewall of the cap.

15. The solderless surface mount fuse of claim 14, wherein the terminals define respective cradles that receive the bottom edges of the respective adjacent sidewalls of the cap.

16. The solderless surface mount fuse of claim 9, wherein the fuse filler covers a top of the separation portion.

* * * * *